US009994294B1

(12) United States Patent
Kim

(10) Patent No.: US 9,994,294 B1
(45) Date of Patent: Jun. 12, 2018

(54) OUTBOARD MARINE ENGINES HAVING VERTICAL CAMSHAFT ARRANGEMENTS

(71) Applicant: Brunswick Corporation, Lake Forest, IL (US)

(72) Inventor: Bo K. Kim, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

(21) Appl. No.: 15/405,510

(22) Filed: Jan. 13, 2017

(51) Int. Cl.
*B63H 20/00* (2006.01)
*B63H 20/24* (2006.01)

(52) U.S. Cl.
CPC ..... *B63H 20/002* (2013.01); *B63H 20/24* (2013.01); *B63B 2758/00* (2013.01)

(58) Field of Classification Search
CPC ..... B63H 20/002; B63H 20/24
See application file for complete search history.

(56) References Cited

U.S. PATENT DOCUMENTS 2,887,180 A * 5/1959 Phillips ..... F01M 9/10 184/6.9
4,651,704 A * 3/1987 Sekiguchi ..... F01L 1/047 123/572
4,819,594 A * 4/1989 Tsakiroglou ..... F01C 1/3562 123/201
5,143,034 A 9/1992 Hirose
5,937,812 A 8/1999 Reedy et al.
6,338,324 B1 1/2002 Tanaka et al.
6,920,856 B2 7/2005 Lee
7,322,327 B1 1/2008 Kim
7,434,572 B2 * 10/2008 Hutter ..... F01M 13/022 123/193.5
7,673,604 B2 3/2010 Takane et al.
8,166,939 B2 5/2012 Lopez-Crevillen et al.
2003/0010318 A1 * 1/2003 Kuroda ..... F01L 1/024 123/432
2005/0118900 A1 * 6/2005 Takahashi ..... B63H 20/002 440/88 L
2007/0283913 A1 * 12/2007 Reinhart ..... F01L 1/047 123/90.34
2010/0180845 A1 * 7/2010 Kurisu ..... F01L 1/352 123/90.17

OTHER PUBLICATIONS

Unpublished U.S. Appl. No. 15/254,127, filed Sep. 1, 2016.

* cited by examiner

*Primary Examiner* — Stephen P Avila
(74) *Attorney, Agent, or Firm* — Andrus Intellectual Property Law, LLP

(57) ABSTRACT

An outboard marine engine comprises a vertically-aligned bank of piston-cylinders. An axially elongated camshaft operates a plurality of valves for controlling flow of air with respect to the vertically-aligned bank of piston-cylinders. The camshaft vertically extends between a lower camshaft end and an upper camshaft end. A lubricant passage axially conveys lubricant through the camshaft. An air outlet is located at the upper camshaft end. A valve is configured to open and close the air outlet to thereby facilitate lubrication of the plurality of valves at startup of the outboard marine engine.

20 Claims, 11 Drawing Sheets

OUTBOARD MARINE ENGINES HAVING VERTICAL CAMSHAFT ARRANGEMENTS

FIELD

The present disclosure relates to marine engines, and particularly to outboard marine engines having vertical camshaft arrangements.

BACKGROUND

U.S. patent application Ser. No. 15/254,127, filed Sep. 1, 2016, is incorporated herein by reference in entirety and discloses an outboard marine engine having a vertically-aligned bank of piston-cylinders; a camshaft that operates a plurality of valves for controlling flow of air with respect to the vertically-aligned bank of piston-cylinders, the camshaft vertically extending between a lower camshaft end and an upper camshaft end; and a cam lobe located at the upper camshaft end. Rotation of the camshaft causes the cam lobe to operate an uppermost valve in the plurality of valves. A lubricant circuit extends through the camshaft and has a lubricant outlet located at the upper camshaft end. The lubricant outlet is configured to disperse lubricant onto the uppermost valve, and particularly onto a valve bucket associated with the uppermost valve, which is located above an uppermost cam bearing bulkhead for the upper camshaft end.

U.S. Pat. No. 9,228,455 is incorporated herein by reference in entirety and discloses a marine engine for an outboard motor comprising a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

U.S. Pat. No. 7,673,604 is incorporated herein by reference in entirety and discloses a valve mechanism that drives an exhaust valve with a valve lifter and an exhaust camshaft. Oil is supplied to a journal surface of the camshaft and a bearing supporting the camshaft journal surface through an axial oil passage formed in the camshaft. The bearing is defined by a cam bucket and a bearing main body. An oil collecting recess is defined between cam bucket and the bearing main body. An auxiliary delivery passage extends from the oil collecting recess to a sidewall of the bearing that is located adjacent to the valve lifter. A guide wall is formed in the sidewall to lead oil from an opening of the auxiliary delivery passage to a part of the valve lifter that generates a striking noise in the absence of buffering oil.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. An outboard marine engine comprises a vertically-aligned bank of piston-cylinders. An axially elongated camshaft operates a plurality of valves for controlling flow of air with respect to the vertically-aligned bank of piston-cylinders. The camshaft vertically extends between a lower camshaft end and an upper camshaft end. A lubricant passage axially conveys lubricant through the camshaft. An air outlet is located at the upper camshaft end. A valve opens and closes the air outlet to thereby facilitate lubrication of the plurality of valves at startup of the outboard marine engine.

BRIEF DESCRIPTION OF THE DRAWINGS

The present disclosure includes the following Figures. The same numbers are used throughout the Figures to reference like features and like components.

FIG. 1 is a rear view of a marine engine.

FIG. 2 is a bottom view of the marine engine shown in FIG. 1.

FIG. 3 is a view of a chain drive for the marine engine shown in FIG. 1, including a crankshaft and pair of dual overhead cam arrangements.

FIG. 4 is a view of one of the dual overhead cam arrangements.

FIG. 5 is a perspective view of a marine engine, having a portion of the intake camshaft shown in section view.

FIG. 6 is a perspective view of the marine engine of FIG. 5 having a portion of the exhaust camshaft shown in section view.

FIG. 7 is a section view of oil passages in a cam bearing for the intake camshaft and in the intake camshaft.

FIG. 8 is a section view of the vertically upper end of the exhaust camshaft and a top bucket on a vertically uppermost engine exhaust valve.

FIG. 9 is a section view of the vertically upper end of the intake camshaft and a valve bucket on a vertically uppermost engine intake valve.

FIG. 10 is a perspective view of a cam cap and an upper cam bearing.

FIG. 11 is a perspective view of an upper camshaft end representative of the intake and exhaust camshafts.

DETAILED DESCRIPTION OF THE DRAWINGS

The following description of FIGS. 1-11 is taken from the above-incorporated U.S. patent application Ser. No. 15/254,127.

Figure 1:
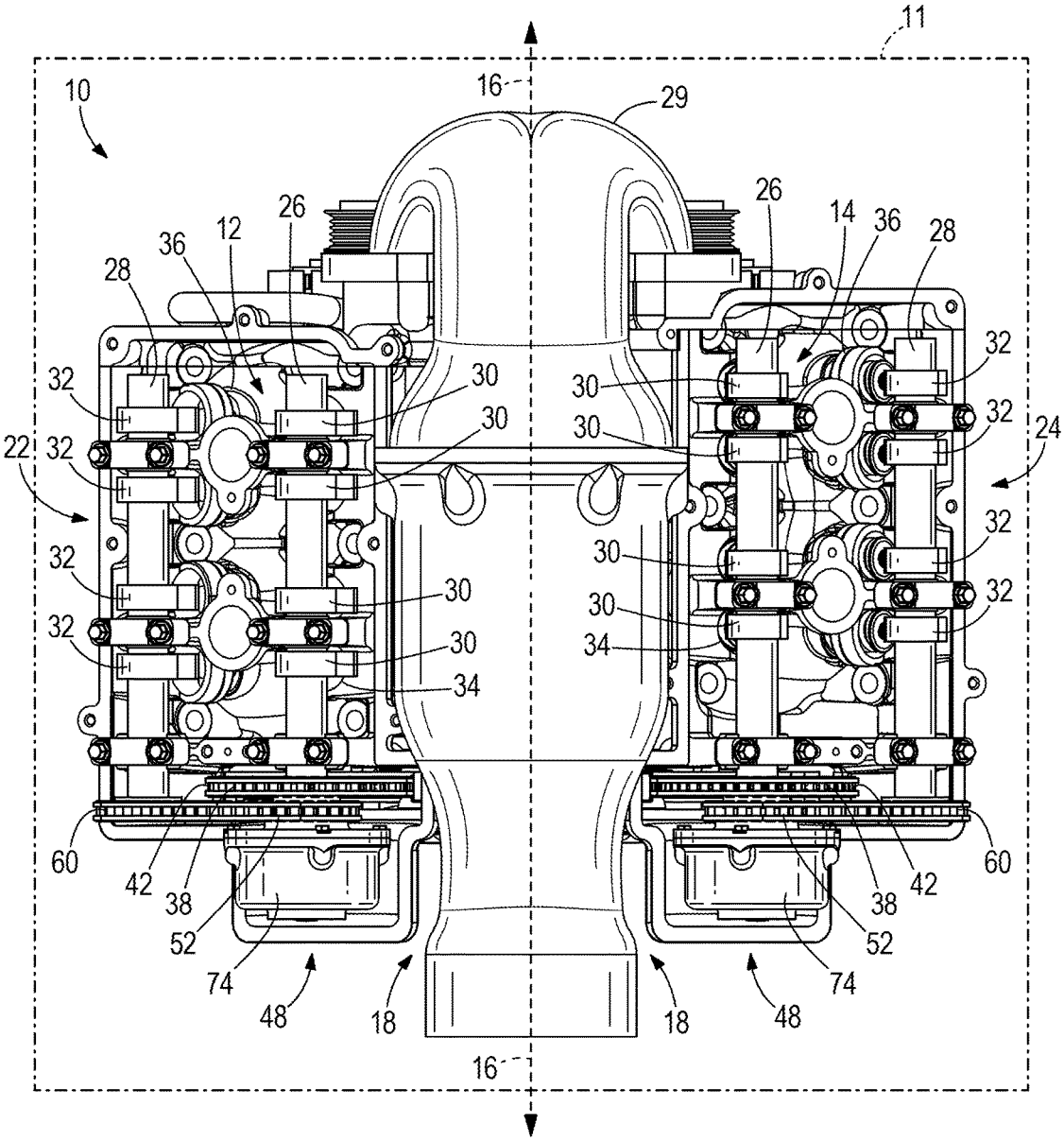
FIGS. 1-11 are taken from the above-incorporated U.S. patent application Ser. No. 15/254,127.
Figure 2:
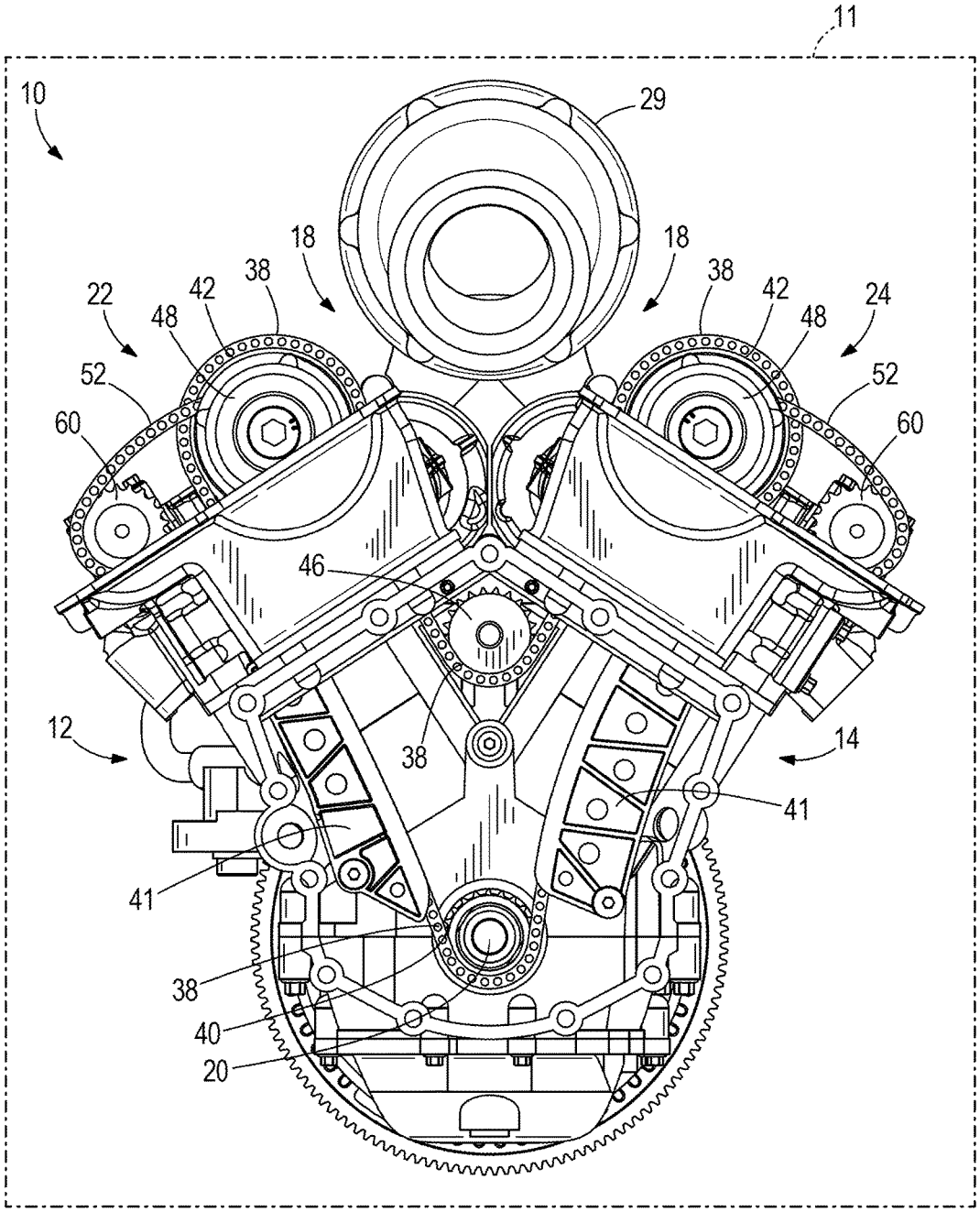
Figure 4:
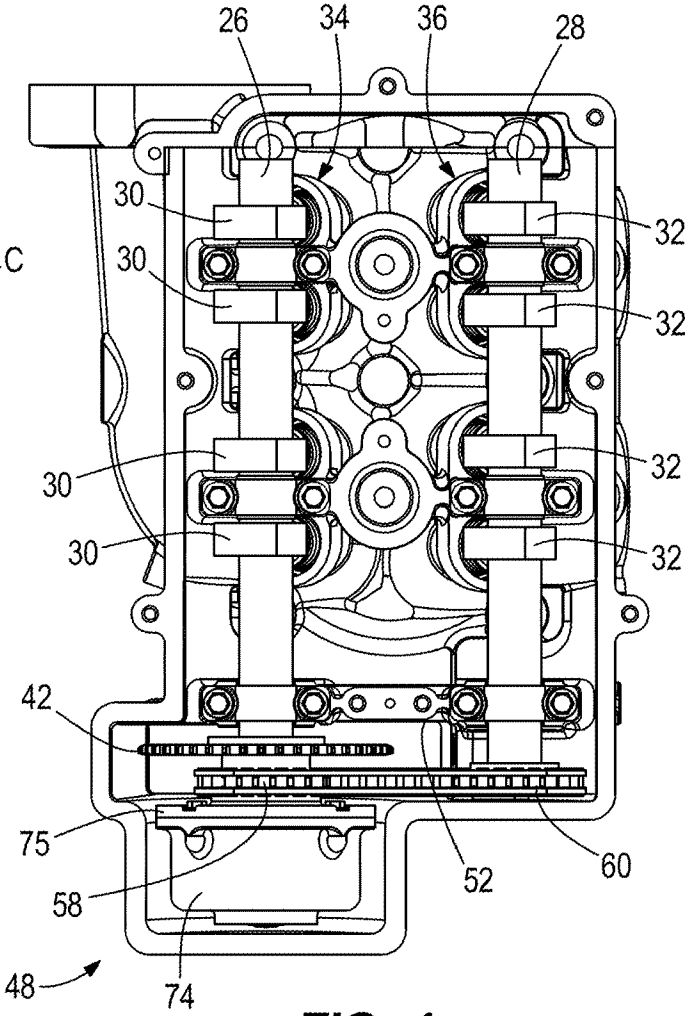

FIGS. 1-2 depict an internal combustion engine 10 for an outboard motor 11. The engine 10 has first and second banks of piston-cylinders 12, 14 that are disposed along a vertical, longitudinal axis 16. The first and second banks of piston-cylinders 12, 14 extend transversely from each other and transversely from the longitudinal axis 16 in a V-shape (see FIG. 2) so as to define a valley 18 there between. As is conventional, combustion of air and fuel in the first and second banks of piston-cylinders 12, 14 causes reciprocation of pistons (not shown) in the banks of piston-cylinders 12, 14, which via connecting rods (not shown), causes rotation of a crankshaft 20 about the longitudinal axis 16.

FIGS. 1-4 depict dual overhead cam arrangements 22, 24 that are disposed on each of the first and second banks of piston-cylinders 12, 14. The dual overhead cam arrangements 22, 24 are configured such that rotation of the crankshaft 20 (see FIG. 3, arrows A) about the longitudinal axis 16 allows flow of intake air to the first and second banks of piston-cylinders 12, 14 and allows flow of exhaust gas from the first and second banks of piston-cylinders 12, 14. More specifically, each dual overhead cam arrangement 22, 24 includes an exhaust camshaft 26 and an intake camshaft 28. The exhaust camshaft 26 and intake camshaft 28 extend parallel to each other and extend parallel to the longitudinal axis 16 shown in FIG. 1. As shown in FIGS. 1 and 2, the exhaust camshaft 26 is located closer to the valley 18 than the intake camshaft 28. Each of the intake and exhaust camshafts 26, 28 carries cam lobes 30, 32 that operate exhaust and intake valves 34, 36, respectively, on the first and second banks of piston-cylinders 12, 14. The exhaust valves 34 are located closer to the valley 18 than the intake valves 36. Rotation of the crankshaft 20 (arrows A) causes rotation of the intake and exhaust camshafts 26, 28 (see FIG. 3, arrows B, C), which causes rotation of the cam lobes 30, 32, which in turn cams open the exhaust and intake valves 34, 36, respectively. Continued rotation of the intake and exhaust camshafts 26, 28, further rotates the cam lobes 30, 32, which allows springs on the exhaust and intake valves 34, 36 to close the exhaust and intake valves 34, 36, respectively. This opening/closing cycle repeats during the combustion process to allow intake air into the piston-cylinders 12, 14 for combustion and to emit exhaust gas from the piston-cylinders 12, 14 for discharge. An exhaust conduit 29 carries exhaust gas from the piston-cylinders 12, 14.

Figure 3:
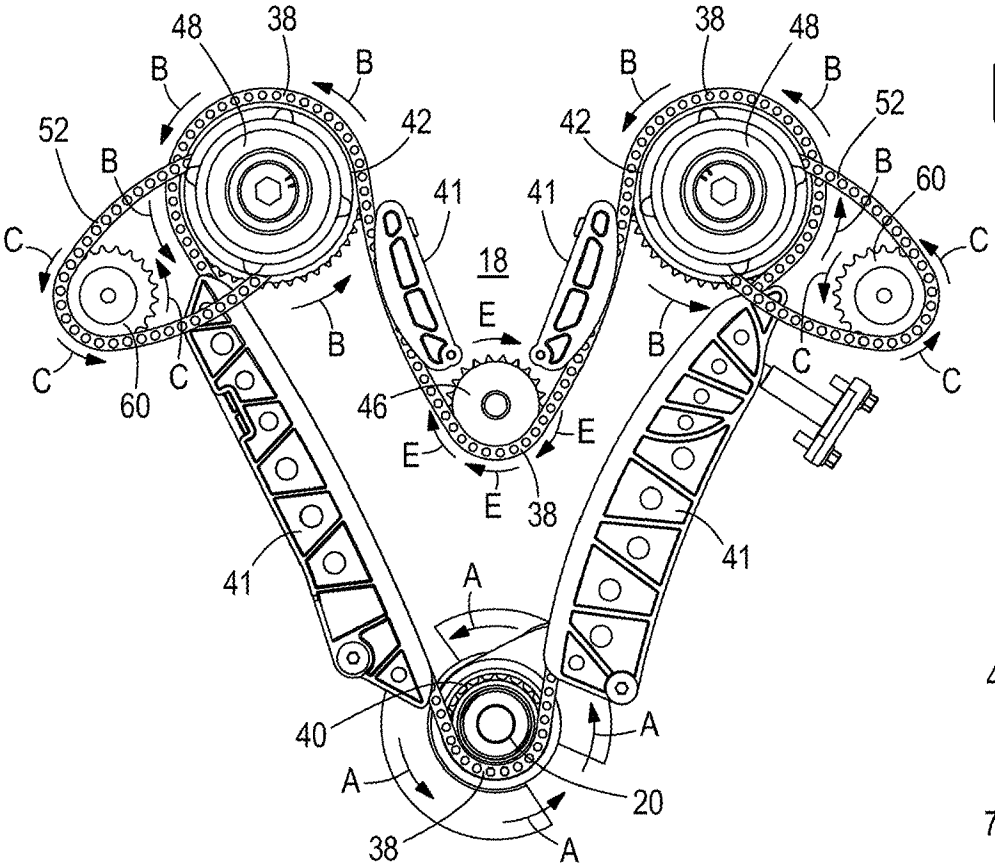

Referring to FIG. 3, combustion in the first and second banks of piston-cylinders 12, 14 causes rotation of the crankshaft 20 (arrows A), which in turn causes rotation of the exhaust camshafts 26 (arrows B). The crankshaft 20 is operatively connected to the exhaust camshafts 26 via a flexible connector, which in this example is a chain 38. The type of connector can vary and in certain examples can include a belt, gear and/or the like. The chain 38 is driven into movement by a drive sprocket 40, which is disposed on the crankshaft 20 and engaged with the chain 38. Movement of the chain 38 engages with sprockets 42 on the exhaust camshafts 26, thereby causing rotation of the exhaust camshafts 26 (arrows B) about their own axes. An idler sprocket 46 is located at a center of the valley 18. The idler sprocket 46 is engaged with and driven into rotation about its own axis (arrows E) by movement of the chain 38. The idler sprocket 46 supports movement of the chain 38. Movement of the chain is also supported by conventional chain guides 41.

In FIGS. 1-4, additional cam phaser-related features represented by reference characters 48, 52, 58, 60, 74, and 75 operate in accordance with the principles described in the above-incorporated U.S. Pat. No. 9,228,455 to cause phased rotational movement, for example shown by arrows C in FIG. 3. These phasing features and other features are more fully explained in the incorporated U.S. Patent. These features are not central to the present disclosure and thus, for brevity, are not further herein described.

Figure 5:
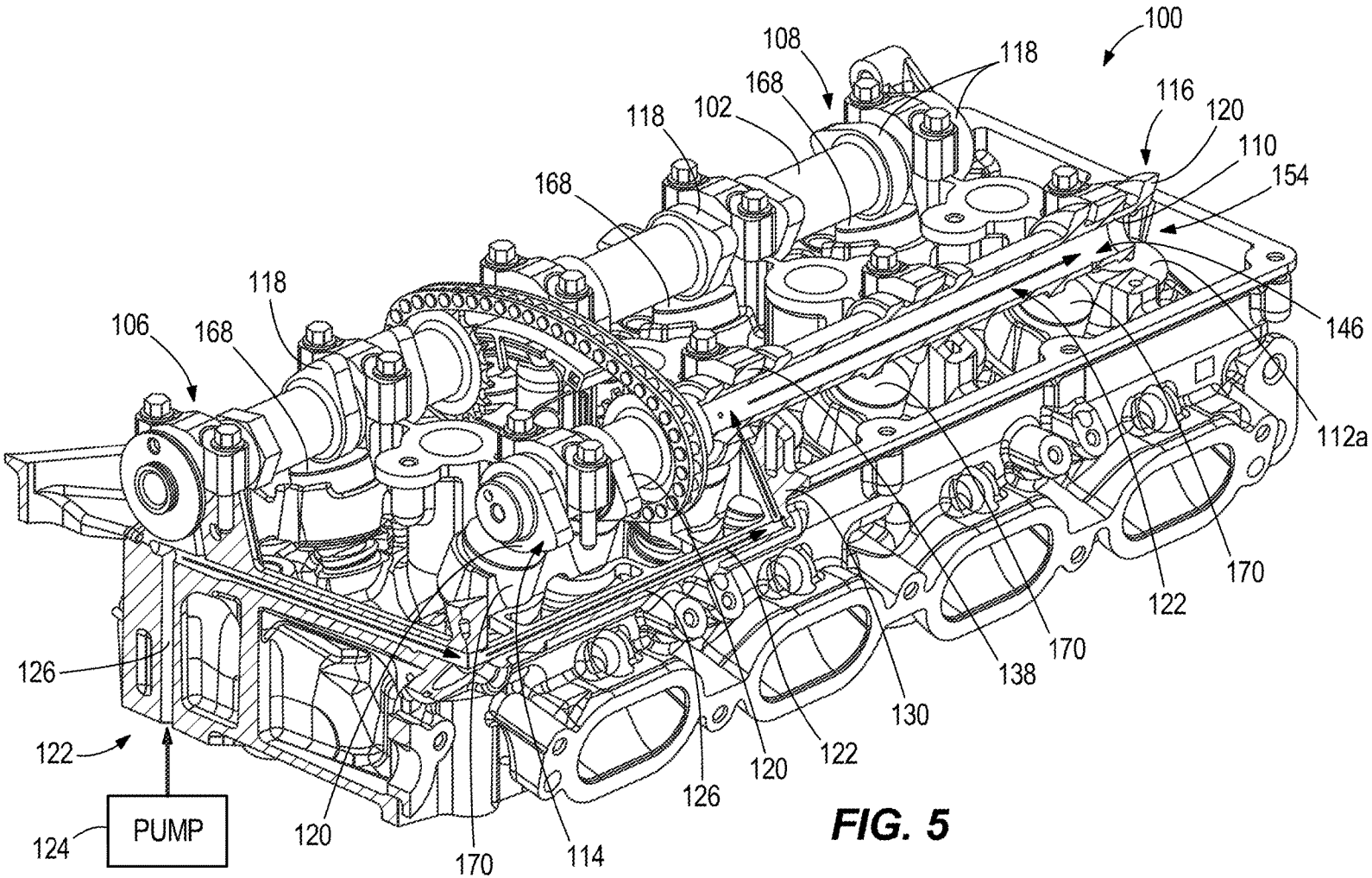
Figure 6:
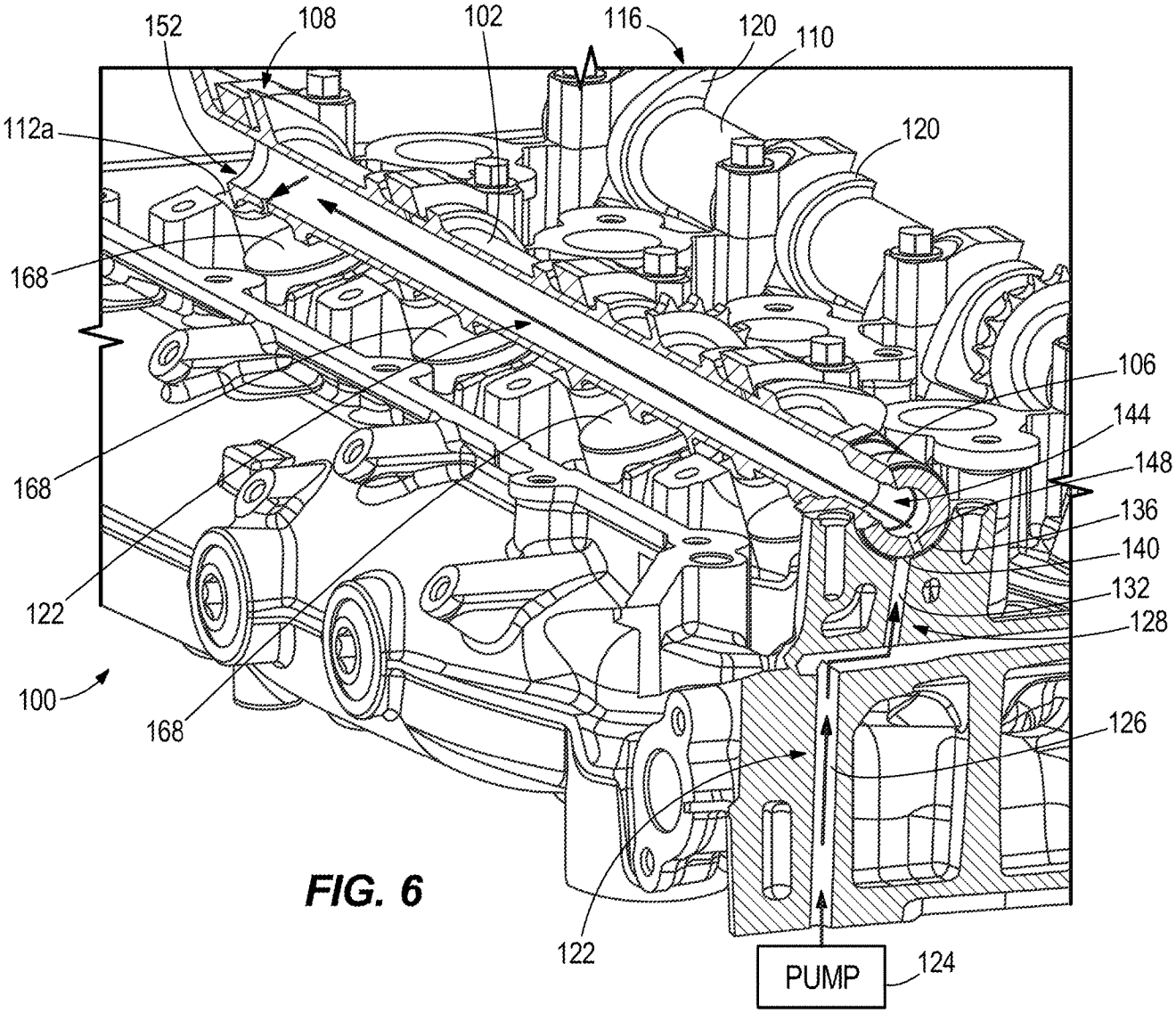

FIGS. 5 and 6 depict an exemplary cylinder head 100 according to the disclosure of the above-incorporated U.S. patent application Ser. No. 15/254,127. The cylinder head 100 is similar to the example shown in FIGS. 1-4 in that it is configured for an engine block having a vertically-aligned bank of piston cylinders. (see, for example the vertically-aligned banks of piston cylinders shown in FIG. 1). An exhaust camshaft 102 is located on the cylinder head 100. The exhaust camshaft 102 operates a plurality of exhaust valves 104 (see FIG. 8) which control flow of exhaust gas from the vertically-aligned bank of piston cylinders. The exhaust camshaft 102 vertically extends between a lower exhaust camshaft end 106 and an upper exhaust camshaft end 108. Exhaust cam lobes 118 are disposed on the exhaust camshaft 102 and, as described further herein below, are configured such that rotation of the exhaust camshaft 102 causes each exhaust cam lobe 118 to operate (i.e., cam open) a corresponding exhaust valve 104 in the plurality of exhaust valves 104. An intake camshaft 110 is located on the cylinder head 100. The intake camshaft 110 operates a plurality of intake valves 112 (see FIG. 9) that control flow of intake air to the vertically-aligned bank of piston cylinders. The intake camshaft 110 vertically extends between a lower intake camshaft end 114 and an upper intake camshaft end 116. Intake cam lobes 120 are disposed on the intake camshaft 110 and, as described further herein below, are configured such that rotation of the intake camshaft 110 causes the intake cam lobes 120 to operate (i.e., cam open) a respective intake valve 112 in the plurality of intake valves 112.

Figure 7:
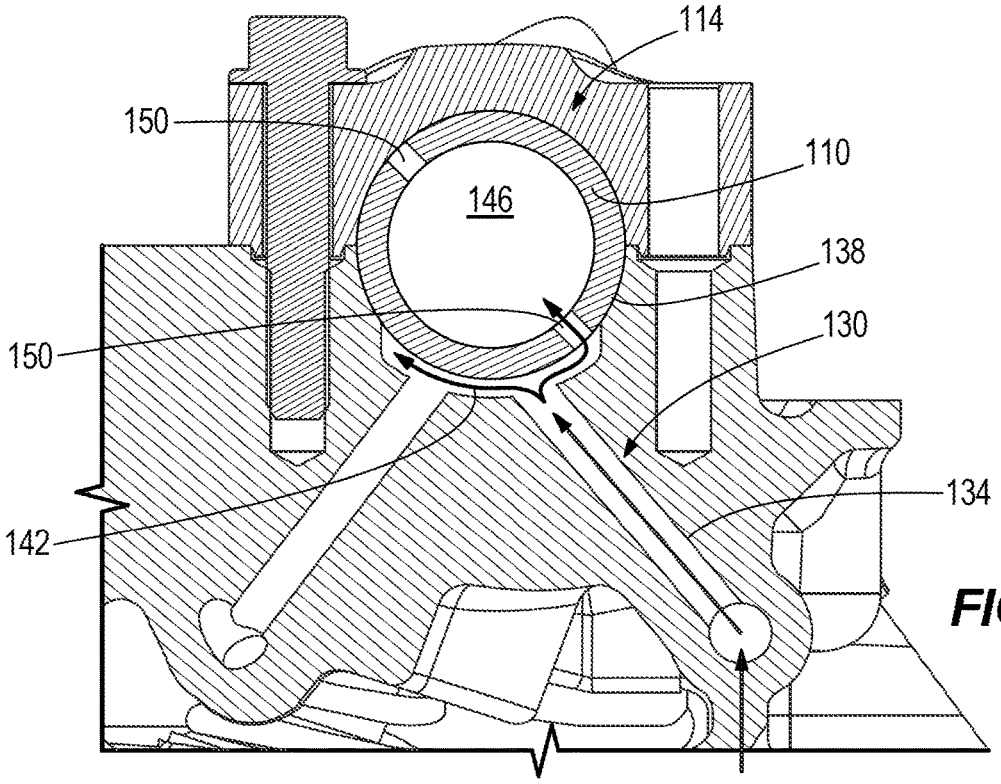

A lubricant circuit (portions referred to generally at reference number 122) extends in part through the exhaust camshaft 102 and through the intake camshaft 110. The lubricant circuit 122 is a circuitous pathway having a series of inlets, outlets, and passages for conveying lubricating fluid, such as oil, to valve buckets 168 on the exhaust valves 104, valve buckets 170 on the intake valves 112 and cam bearing bulkheads 164, 166, as further described herein below. Referring to FIGS. 5-7, the lubricant circuit 122 receives pressurized lubricant from a lubricant pump 124. The lubricant pump 124 is a conventional device that is configured to pump the lubricant from a lubricant source (e.g. a reservoir) located elsewhere in the outboard marine engine. The lubricant is pumped into an inlet passageway 126 formed in the cylinder head 100 to lubricant inlets 128, 130 for supplying the lubricant to the lower exhaust camshaft end 106 and the lower intake camshaft end 114, respectively. The lubricant inlets 128, 130 include a respective lubricant passageway 132, 134 formed in a respective cam bearing journal 136, 138. The lubricant passageways 132, 134 convey the lubricant from the inlet passageway 126 to a respective recess 140, 142 formed in the respective cam bearing journal 136, 138. The exhaust camshaft 102 and intake camshaft 110 each have a respective oil gallery 144, 146 (referred to herein below as a "lubricant passage") formed therein for vertically conveying the lubricant there through. Pairs of diametrically opposite radial inlet holes 148 (only one shown), 150 are formed in the exhaust camshaft 102 and intake camshaft 110. The radial inlet holes 148, 150 are oriented 180° apart and are configured to open to the respective recess 140, 142 formed in the respective lower cam bearing journal 136, 138. The radial inlet holes 148, 150 are configured to open to the recesses 140, 142 in the lower cam bearing journal 136, 138, respectively, upon each 360 degree rotation of the respective intake and exhaust camshafts 102, 110, thereby intermittently allowing the lubricant to flow into the respective oil galleries 144, 146, under pressure from the pump 124. It should be noted that the above-described configuration can vary from what is described. For example, on the exhaust camshaft 102, it is possible to include only one hole 148. In this example, the oil passage 132 communicates with a groove formed 360° around the camshaft journal, which feeds the hole 148. Other configurations are possible within the scope of this disclosure.

Under pressure from pump 124, the lubricant flows vertically upwardly through the oil galleries 144, 146 from the lower exhaust camshaft end 106 and lower intake camshaft end 114 to the upper exhaust camshaft end 108 and upper intake camshaft end 116, respectively. Referring to FIGS. 8-11, lubricant outlets 152, 154 are located at the upper exhaust camshaft end 108 and upper intake camshaft end 116, respectively and are configured to disperse the lubricant at the location of and onto the uppermost exhaust valve 104*a* and at the location of and onto the upper most intake valve 112*a*, respectively. Referring to FIGS. 8-11, the lubricant outlets 152, 154 each have one or more radial lubricant outlet hole 156, 158. Each radial lubricant outlet hole 156, 158 opens to a respective lubricant passageway 160, 162 formed in an uppermost cam bearing bulkhead 164, 166 for supporting rotation of the respective exhaust and intake camshafts 102, 110. In this manner, the radial lubricant outlet holes 156, 158 are configured to intermittently disperse the lubricant from the oil galleries 144, 146 in the camshafts 102, 110 to the lubricant passageways 160, 162 in the uppermost cam bearing bulkheads 164, 166. It should be noted that the above-described configuration can vary from what is described. In some examples, the lubricant outlets 152 and/or 154 have pairs of diametrically opposite radial lubricant outlet holes 156, 158.

Figure 8:
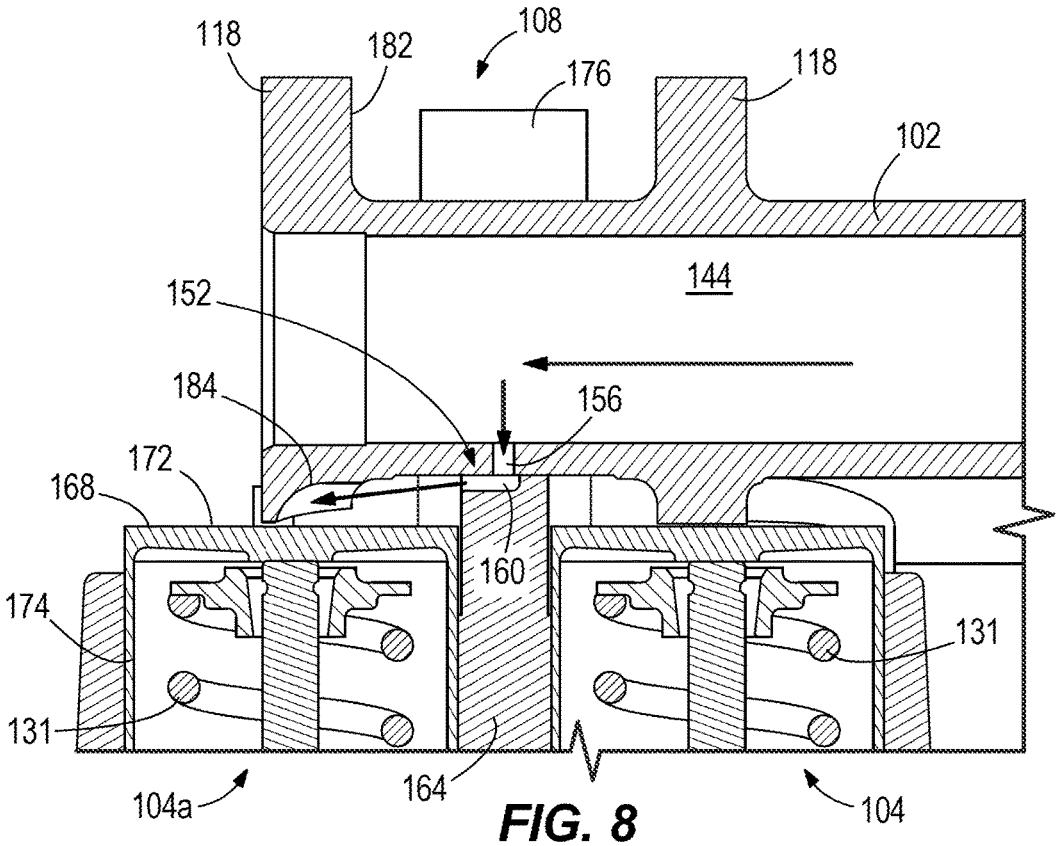
Figure 9:
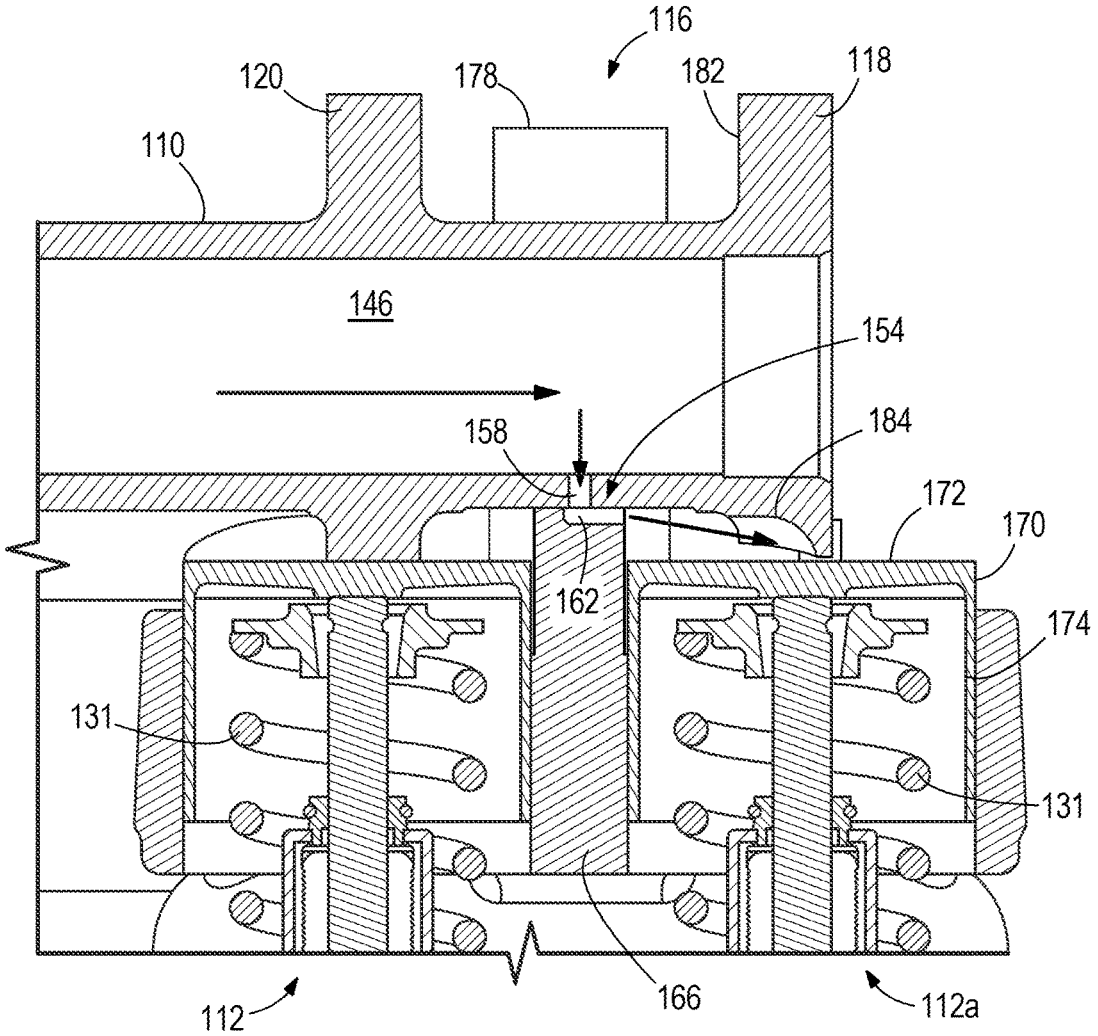
Figure 10:
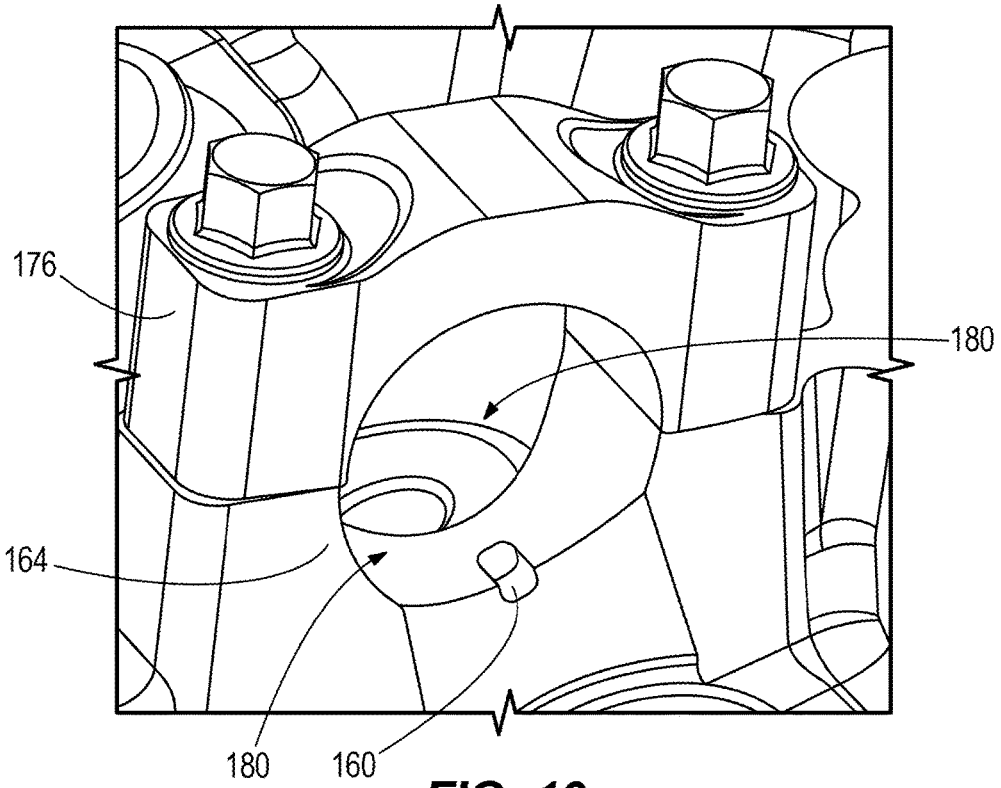

Referring to FIGS. 8 and 9, the uppermost exhaust valve 104*a* and uppermost intake valve 112*a* have valve buckets 168, 170 that are cammingly engaged by the respective cam lobes 118, 120 during rotation of the camshafts 102, 110. Rotation of the camshafts 102, 110 causes the cam lobes 118, 120 to cam the valve buckets 168, 170 against the bias of springs 131. The cam lobes 118, 120 and springs 131 operate together to open and close the respective valves 104*a*, 112*a*. The valve buckets 168, 170 have an end wall 172 and a perimetral side wall 174. Advantageously, the lubricant outlets 152, 154 are configured to disperse the lubricant via the noted lubricant passageways 160, 162 in the uppermost cam bearing bulkheads 164, 166 onto the end wall 172 of the valve buckets 168, 170. Thus the lubricant is effectively dispersed onto the respective uppermost valves 104*a*, 112*a*, particularly onto the valve buckets 168, 170 at a location above the uppermost cam bearing bulkheads 164, 166 in a manner that enhances lubrication of the uppermost interface between the cam lobes 118, 120 and the valve buckets 168, 170.

Figure 11:
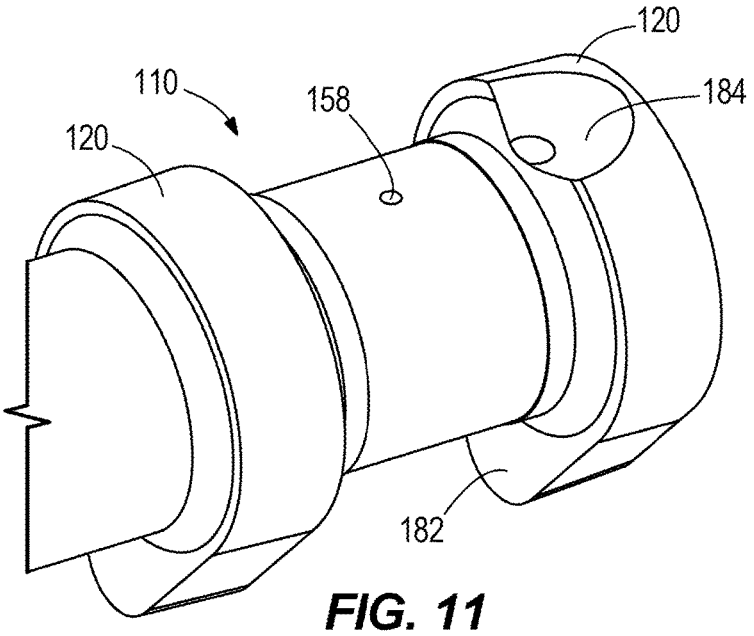
Figure 12:
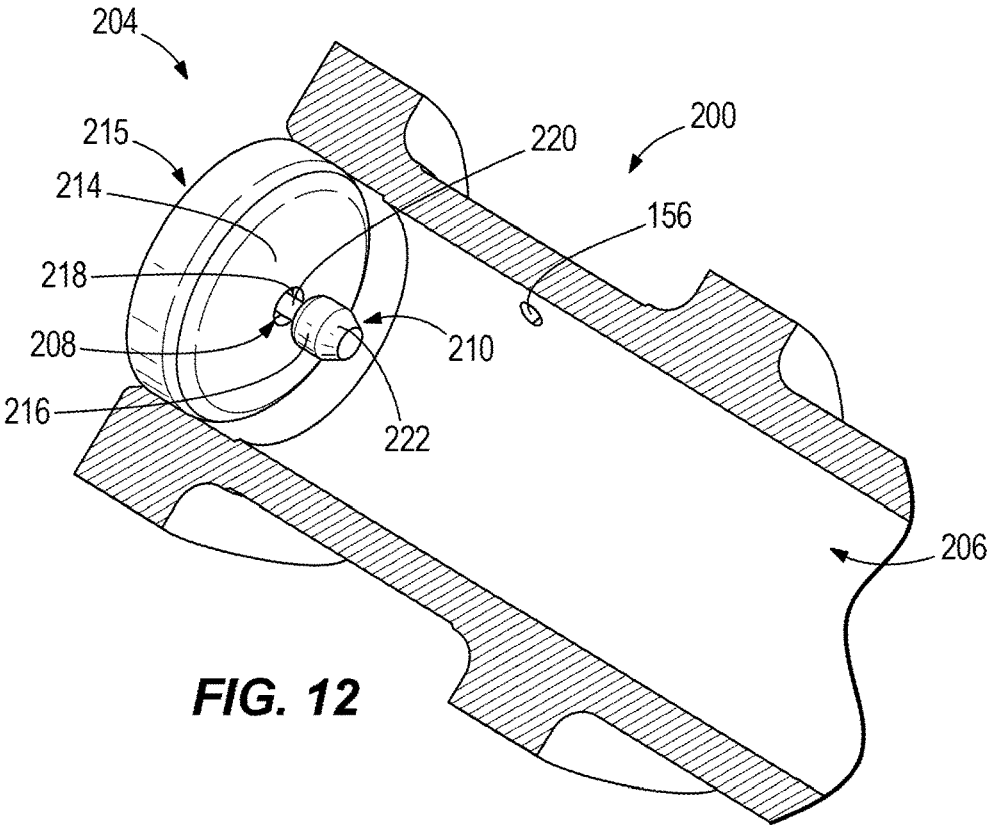
FIG. 12 is a sectional view looking upwardly at the upper end of a camshaft showing one example of a valve according to the present disclosure.
Figure 13:
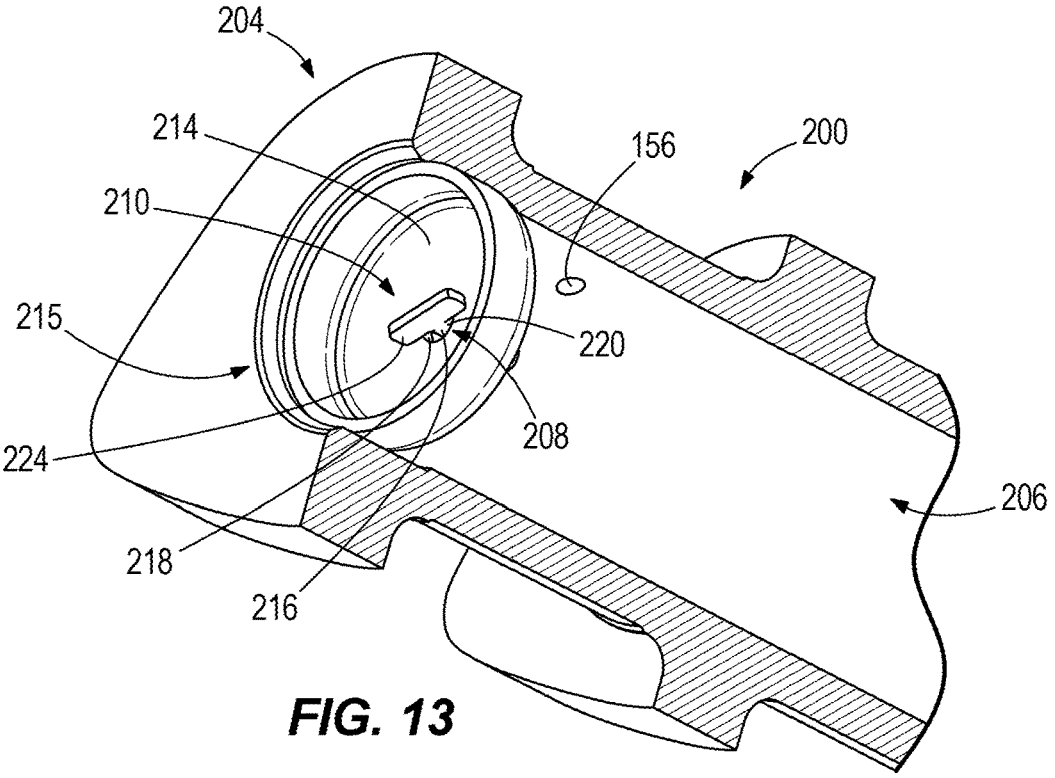
FIG. 13 is a sectional view looking downwardly at the upper end of the camshaft and valve.
Figure 14:
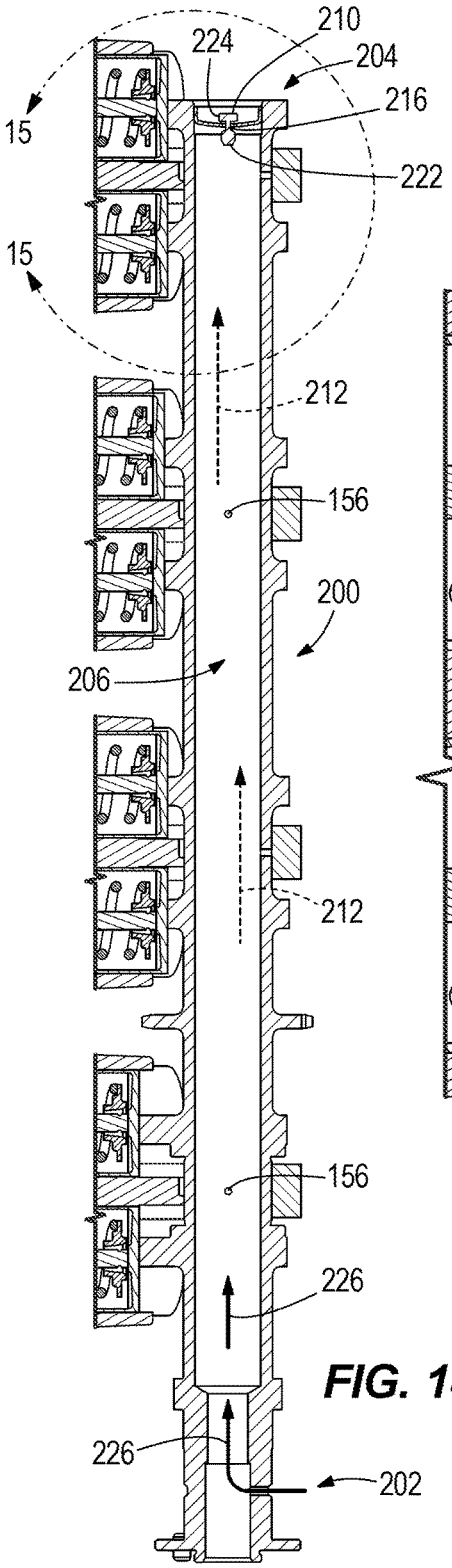
FIG. 14 is a sectional view showing the camshaft and the valve in an open position.
Figure 15:
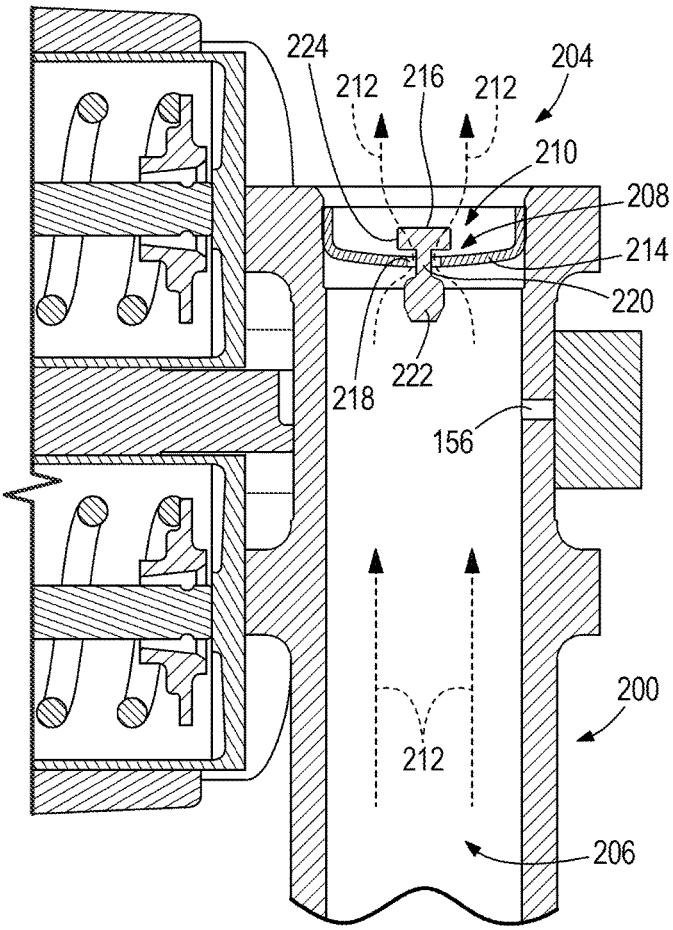
FIG. 15 is a view of Section 14-14, taken in FIG. 14.
Figure 16:
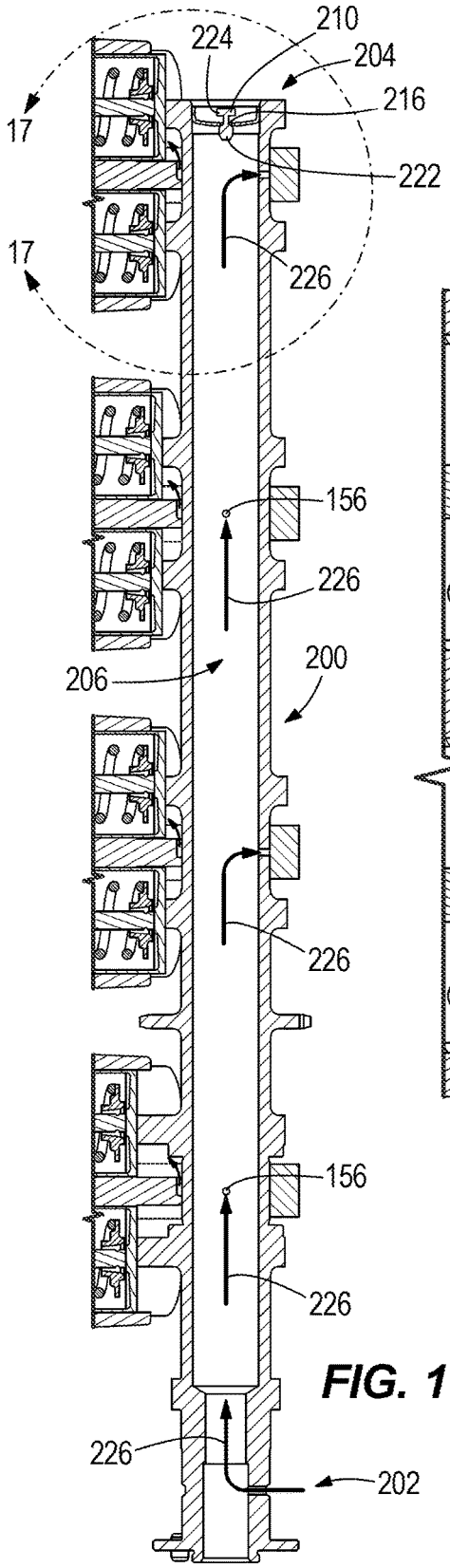
FIG. 16 is a sectional view showing the camshaft and the valve in a closed position.
Figure 17:
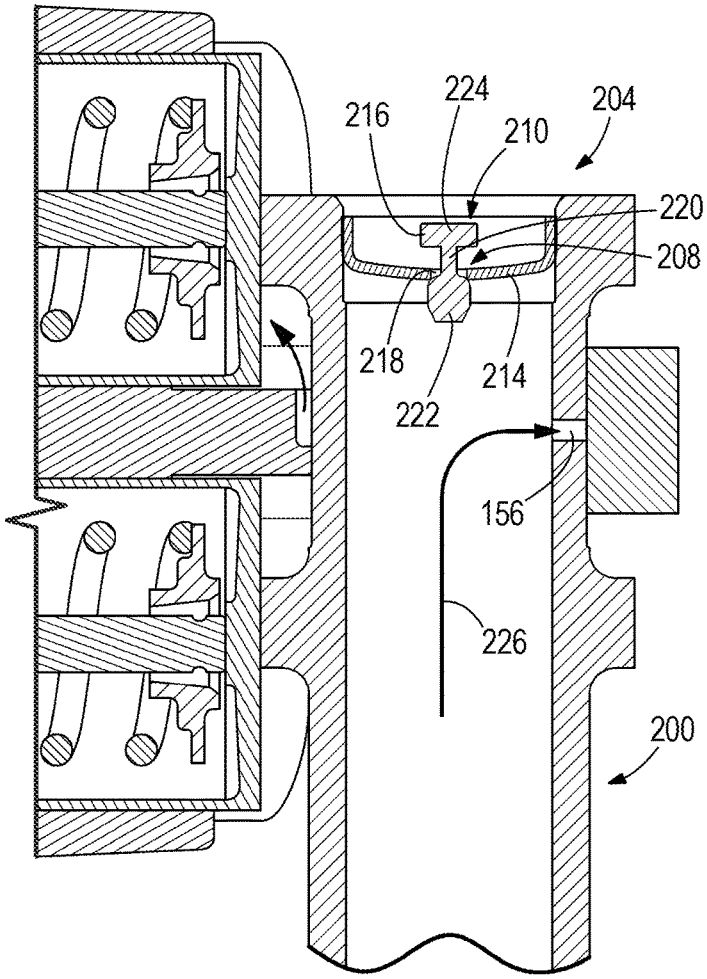
FIG. 17 is a view of Section 17-17, taken in FIG. 16.

Referring to FIGS. 8-11, the upper cam bearing bulkheads 164, 166 each have an upper cam cap 176, 178. The respective camshaft 102, 110 extends through a tunnel 180 formed between the upper cam cap 176, 178 and uppermost cam bearing bulkhead 164, 166. Each cam lobe 118, 120 that is located vertically above the upper cam cap 176, 178 and uppermost cam bearing bulkhead 164, 168 has a side wall 182 with a cut out 184 that permits the lubricant to intermittently pass from the lubricant passageway 160, 162 in the uppermost cam bearing bulkhead 164, 166 to the end wall 172 of the respective valve bucket 168, 170 during rotation of the respective camshaft 102, 110. The cam lobe 118, 120 has a teardrop-shaped cutout, as shown in FIG. 11.

The following description relates to FIGS. 12-17, which are more particularly directed to the present disclosure.

The present inventor has conducted research and experimentation in the field of outboard marine engines having vertically oriented camshafts, such as the outboard marine engines discussed herein above with reference to FIGS. 1-11. During research and experimentation, the present inventor has recognized that at engine shutdown, lubricant typically drains by gravity out of the oil galleries (i.e., lubricant passages) in the camshafts. Thereafter, at engine startup, an amount of time is required to re-fill the lubricant passages. For example, about 2.7 seconds was required to fill a conventional 19.5 diameter hollow camshaft at engine startup. In the meantime, the camshaft operates (i.e. rotates) without lubrication on the shaft, journals, etc. The present inventor has found that this can disadvantageously wear and ultimately damage the respective components.

During research and experimentation, the present inventor has also recognized that it is desirable to make the camshaft as lightweight as possible, and thus it is often desirable to maximize the diameters of the hollow lubricant passages in the camshafts. However, maximizing the diameters of the lubricant passages inherently increases the amount of time required to fill the passages at engine start-up, and thus increases the above-described potential for wear and damage on the camshafts.

Based on these recognitions, the present inventor has endeavored to invent camshaft arrangements for outboard marine engines that are relatively lightweight, and wherein the time required to fill the camshaft passages with lubricant at engine startup is minimized. The present disclosure is a result of these efforts.

FIGS. 12-17 depict an exemplary camshaft 200 configured for use in an outboard marine engine, such as for example the outboard marine engine 10 described herein above. As described herein above, the camshaft 200 is configured to operate a plurality of intake or exhaust valves (e.g., 34, 36) for controlling flow of intake or exhaust air with respect to a vertically-aligned bank of piston cylinders (e.g., 12, 14). The camshaft 200 extends between a lower camshaft end 202 and an upper camshaft end 204. A lubricant passage 206 extends through the camshaft 200 and is configured to convey lubricant through the camshaft 200 for disbursement of the lubricant to the above-described various components on the engine 10, including for example the cam lobes, e.g., 30, 32, exhaust and intake valves e.g., 34, 36, and/or cam caps e.g., 176, 178, as described herein above. The lubricant is dispersed via radial lubricant outlets e.g., 156, 158, which can for example be formed along the length of the camshaft 200 at the location of the various components to be lubricated, as described herein above.

According to the present disclosure, an air outlet 208 is located at the upper camshaft end 204. A valve 210 is located at the upper camshaft end 204 and is configured to facilitate fast lubrication of the plurality of valves 34, 36 at start-up of the outboard marine engine 10. Referring to FIGS. 12-15, the valve 210 is normally open at start-up of the outboard marine engine 10 and thus allows air to quickly evacuate the lubricant passage 206 as the lubricant fills the lubricant passage 206. Flow of air through and out of the lubricant passage 206 is illustrated via dashed arrows 212 in FIGS. 14 and 15.

The valve 210 is formed in an axial end wall 214 on the lubricant passage 206 at the upper camshaft end 204. In the illustrated example, the axial end wall 214 is formed by a cap 215 that is fixed to the inner diameter of the lubricant passage 206. The type and configuration of the axial end wall 214 and valve 210 can vary from that which is shown. In the illustrated example, the valve 210 includes a valve member 216 that extends through an opening 218 formed in the axial end wall 214. The valve member 216 includes a shaft 220 that extends through the opening 218 and a plug 222 located in the lubricant passage 206. The plug 222 is configured to plug the opening 218 under pressure from the lubricant as it fills the lubricant passage 206, as will be described further herein below. The plug 222 is located on a first end of the shaft 220 and has a diameter that is larger than the diameter of the opening 218. A hanger 224 is located on an opposite, second end of the shaft 220. The hanger 224 is configured to prevent the valve 210 from falling into the lubricant passage 206 under force of gravity when the outboard marine engine 10 is turned off. The hanger 224 is sized larger than the opening 218 so that the hanger 224 engages the outer surface of the axial end wall 214 and prevents the valve 210 from falling into the lubricant passage 206. In other examples, the valve 210 can include a spring that returns the valve 210 into the open position.

Force of gravity on the valve member 216 causes the valve 210 to normally reside in the open position shown in FIGS. 12-15. At startup of the outboard marine engine 10, the pump 124 pumps the lubricant into the lubricant passage 206 at the lower camshaft end 202, as described herein above with respect to FIGS. 1-11. Flow of lubricant into the lubricant passage 206 is shown via solid arrows 226 in FIGS. 14-17. As the lubricant fills the lubricant passage 206, the air inside the lubricant passage 206 is rapidly forced out of the camshaft 200 via the radial outlet holes e.g., 156 in the camshaft 200 and via the noted valve 210, particularly the space between the shaft 220 and the inner diameter of the opening 218. Once the lubricant completely fills the lubricant passage 206, the lubricant forces the valve 210 upwardly until the plug 222 seats in the opening 218 and thereby plugging the opening 218 under pressure from the lubricant.

The configuration and dimensions of the valve 210 can vary from what is shown. The opening 218 can have a variety of diameters, and in some examples has a 3.0 mm diameter. Advantageously, the valve 210 reduces restriction of air flow through the lubricant passage 206 at start-up, relative to conventional arrangements, which thus results in a reduced amount of time necessary to fill the lubricant passage at start-up of the outboard marine engine 10. For example, the present inventor found that a 19.5 mm diameter hollow camshaft according to an example of the present disclosure required only about 0.06 seconds to fill with lubricant, whereas conventionally about 2.7 seconds was required. After the air escapes from the lubricant passage 206, the lubricant pressure builds up and closes the valve 210, which thereby maintains pressure of the lubricant within the lubricant passage 206.

It will thus be seen that the present embodiments allow for minimized lubricant fill-up time for hollow camshaft arrangements and minimize unlubricated operating conditions during engine start-up. This advantageously improves camshaft durability, simplifies cam journal oil passage design, and provides weight reduction.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An outboard marine engine comprising:

a vertically-aligned bank of piston-cylinders;

an elongated camshaft that operates a plurality of valves for controlling flow of air with respect to the vertically-aligned bank of piston-cylinders, the camshaft extending between a lower camshaft end and an upper camshaft end;

a lubricant passage that conveys lubricant through the camshaft;

an air outlet located at the upper camshaft end; and a valve that opens and closes the air outlet to thereby facilitate lubrication of the plurality of valves at startup of the outboard marine engine.

2. The outboard marine engine 1, wherein the valve is normally open at startup of the outboard marine engine and allows the flow of air to evacuate the lubricant passage as the lubricant fills the lubricant passage.

3. The outboard marine engine according to claim 2, wherein the valve is caused to close under pressure from the lubricant as the lubricant fills the lubricant passage.

4. The outboard marine engine according to claim 3, wherein the valve is normally open at startup of the outboard marine engine under force of gravity.

5. The outboard marine engine according to claim 1, further comprising an axial end wall on the lubricant passage at the upper camshaft end, wherein the valve is formed in the axial end wall.

6. The outboard marine engine according to claim 5, wherein the valve comprises a valve member that extends through an opening formed in the axial end wall.

7. The outboard marine engine according to claim 6, wherein the valve member comprises a shaft that extends through the opening and a plug disposed in the lubricant passage, wherein the plug is configured to plug the opening under pressure from the lubricant as the lubricant fills the lubricant passage.

8. The outboard marine engine according to claim 7, wherein the plug is located on a first end of the shaft and has a diameter that is larger than the opening.

9. The outboard marine engine according to claim 8, further comprising a hanger located on an opposite, second end of the shaft, wherein the hanger prevents the valve from falling into the lubricant passage under force of gravity when the outboard marine engine is off.

10. The outboard marine engine according to claim 9, wherein the hanger is sized larger than the opening so that the hanger engages the end wall under force of gravity and prevents the valve from falling into the lubricant passage.

11. The outboard marine engine according to claim 1, further comprising a plurality cam bearing bulkheads that support the camshaft and a plurality of radial lubricant outlet holes in the camshaft that are configured to disperse lubricant onto cam bearing bulkheads.

12. The outboard marine engine according to claim 11, wherein the plurality of radial lubricant outlet holes open to the lubricant passageways in the plurality of cam bearing bulkheads upon each 360 degree rotation of the camshaft, thereby intermittently dispersing the lubricant from the camshaft.

13. The outboard marine engine according to claim 1, further comprising a pump that pumps the lubricant into the lubricant passage at the lower camshaft end.

14. The outboard marine engine according to claim 1, wherein the camshaft comprises an intake camshaft and wherein the plurality of valves comprises plurality of intake valves for controlling the flow of air to the vertically-aligned bank of piston-cylinders, the intake camshaft vertically extending between a lower intake camshaft end and an upper intake camshaft end.

15. The outboard marine engine according to claim 1, wherein the camshaft comprises an exhaust camshaft and wherein the plurality of valves comprises a plurality of exhaust valves for controlling the flow of are from the vertically-aligned bank of piston-cylinders, the lower camshaft end comprising a lower exhaust camshaft end and the upper camshaft end comprising an upper exhaust camshaft end.

16. A camshaft configured for use in an outboard marine engine having vertically-aligned bank of piston-cylinders, the camshaft comprising an elongated camshaft body that is configured to operate a plurality of valves for controlling flow of air with respect to the vertically-aligned bank of piston-cylinders, wherein the camshaft extends between a lower camshaft end and an upper camshaft end, a lubricant passage extending through the camshaft and having an air outlet located at the upper camshaft end, and a valve that opens the outlet.

17. The camshaft according to claim 16, wherein the valve is normally open at startup of the outboard marine engine and allows the flow of air to evacuate the lubricant passage as the lubricant fills the lubricant passage, and wherein the valve is caused to close under pressure from the lubricant as the lubricant fills the lubricant passage.

18. The camshaft according to claim 17, further comprising an axial end wall on the lubricant passage at the lower camshaft end, wherein the valve is formed in the axial end wall, wherein the valve comprises a valve member that extends through an opening formed in the axial end wall, wherein the valve member comprises a shaft that extends through the opening and a plug located in the lubricant passage, wherein the plug is configured to plug the opening under pressure from the lubricant as the lubricant fills the lubricant passage.

19. The camshaft according to claim 18, wherein the plug is located on a first end of the shaft and has a diameter that is larger than the opening, further comprising a hanger located on an opposite, second end of the shaft, wherein the hanger prevents the valve from falling into the lubricant passage under force of gravity when the outboard marine engine is off, wherein the hanger is sized larger than the opening so that the hanger engages the end wall under force of gravity and prevents the valve from falling into the lubricant passage.

20. The camshaft according to claim 19, further comprising a pump that pumps the lubricant into the lubricant passage at the lower camshaft end.

* * * * *